United States Patent [19]

Dabling et al.

[11] Patent Number: 5,076,770

[45] Date of Patent: Dec. 31, 1991

[54] GEAR PUMP HAVING IMPROVED LOW TEMPERATURE OPERATION

[75] Inventors: G. Arlan Dabling, Mesa; Dennis L. Cannon, Scottsdale, both of Ariz.

[73] Assignee: Allied-Signal Inc., Morris Township, Morris County, N.J.

[21] Appl. No.: 509,006

[22] Filed: Apr. 13, 1990

[51] Int. Cl.[5] ..... F04C 2/18; F04C 15/00

[52] U.S. Cl. ..... 418/1; 418/102; 418/132; 418/135; 418/189

[58] Field of Search ..... 418/1, 71, 73, 102, 418/132, 189

[56] References Cited

U.S. PATENT DOCUMENTS

| | | | |
|---|---|---|---|
| 246,724 | 9/1881 | Clark | 418/108 |
| 1,972,271 | 9/1934 | McIntyre | 418/189 |
| 2,728,301 | 12/1955 | Lindberg | 418/73 |
| 2,855,854 | 2/1954 | Aspelin . | |
| 2,986,097 | 5/1961 | Chrzanowski et al. . | |
| 2,993,450 | 7/1961 | Weigert | 418/71 |
| 3,306,225 | 2/1967 | Smith | 418/102 |
| 3,371,615 | 3/1968 | Pettyjohn et al. | 418/132 |
| 3,433,168 | 3/1969 | Banker . | |
| 3,560,121 | 2/1971 | Noell . | |
| 3,690,793 | 9/1972 | Pollman et al. | 418/102 |
| 3,748,063 | 7/1973 | Putnam | 418/132 |
| 4,645,439 | 2/1987 | Way | 418/104 |

*Primary Examiner*—John J. Vrablik

*Attorney, Agent, or Firm*—Terry L. Miller; Jerry J. Holden; Robert A. Walsh

[57] ABSTRACT

A gear pump having improved low-temperature operation includes a housing with a cavity wherein is rotatably received a pair of meshed pinion gears. A pair of bushing members matched in external shape to a projection of the pair of gears and complementary to the housing cavity alone journal the pair of gears. The bushings and gears are freely movable relative to the housing at all operating temperatures for the pump, and the bushings are urged by fluid pressure forces into sealing cooperation with the gears and with the housing. The pump achieves an improved pumping volume by directing a trapped intermesh volume to the outlet port of the pump.

10 Claims, 2 Drawing Sheets

GEAR PUMP HAVING IMPROVED LOW TEMPERATURE OPERATION

BACKGROUND OF THE INVENTION

The present invention is in the field of gear pumps. More particularly the present invention relates to a gear pump wherein a pair of meshed straight-cut spur gears are received within a housing having an inlet port and an outlet port leading to and from a cavity wherein the meshed gears are received. One of the meshed gears is driven by an output shaft extending externally of the housing, while the other gear is journaled in the housing as an idler and rotates because of its meshing engagement with the externally driven gear. As the meshed gears rotate in opposite directions successive trapped volumes of fluid are carried by each gear from the inlet passage to the outlet passage. The mesh of the gears prevents fluid from being conveyed in the opposite direction.

Such meshed gear pumps are old and very well known. For example conventional gear pumps are known wherein a housing portion of the pump is adjusted transversely relative to the gears in order to control radial clearance between the housing portion and the tips of the gear teeth. Such gear pumps are set forth in U.S. Pat. No. 246,724 issued 6 Sept. 1881 to A. Clark; and in U.S. Pat. No. 3,433,168, issued 13 Jan. 1967 to O. H. Baker; as well as in U.S. Pat. No. 4,645,439, issued 24 Feb. 1987 to D. R. Way. Also known are conventional gear pumps wherein a portion only of the housing is adjusted transversely of the gear pair in order to control the radial gap between the tips of the gear teeth and the housing portion. Such a conventional gear pump is set forth in U.S. Pat. No. 2,855,854, issued 19 Feb. 1954 to L. L. Aspelin, which teaches that the laterally moving housing portion may be arranged as a pressure balanced component of the gear pump. Still further U.S. Pat. No. 3,560,121, issued 28 Feb. 1969 to G. L. Noell, teaches that the laterally moving portion of the housing may be arranged as a pair of tilting pads each individually engaging one of the meshed gears of the pump and being pressure balanced as a pair to move laterally toward the meshed gears and thereby control the radial clearance between the tilting pad members and the tips of the gears.

In addition to the above discussed teachings which have to do with control of leakage within a gear pump by control of the radial clearances between the gears and a portion or portions of the gear pump housing, U.S. Pat. No. 2,986,097, issued 30 May 1961 to R. S. Chrzanowski et.al. teaches that a gear pump may be provided with a housing secured axially by a pair of tie bolts or tie rod members extending parallel to the shafts of the meshed gears and exceedingly close to the mesh of these gears. These tie bolts preload the housing to resist axial separating forces generated by fluid pressures within the pump. In this way it is hoped to avoid the axial bowing apart of the housing portions of the pump resulting from fluid pressures within the pump. Such separation of the housing portions provides leakage past the meshed gears axially thereof.

An alternative method of providing control of axial clearances within a meshed gear pump is set forth in U.S. Pat. No. 3,748,063, issued 24 July 1973 to R. C. Putnam, wherein an axially movable pressure-balanced plate member is disposed against one axial face of each of the meshed gears. The pressure-balanced plate member biases the gears axially into sliding and sealing engagement with the opposite face of the pump housing, and itself moves into sliding and sealing engagement with the meshed gears in response to controlled pressure forces effective thereon.

However, each of the above referenced gear pumps is believed to suffer from a deficiency only apparent when such gear pumps are subjected to operation at exceedingly low temperatures. Such operation of gear pumps at exceedingly low temperatures occurs in the aerospace art as well as in other arts. By way of example only, in the aerospace art it is desirable for equipment which is carried aboard an aircraft at high altitude and which, therefore, may be exposed to exceedingly low temperatures as low as −65° F., to be able to start and operate successfully at these low temperatures. Unfortunately, conventional gear pumps when they are exposed to this type of dormant cold soak utilization experienced an exceedingly high drag torque when they are first started. This drag torque continues for a considerable period of time until the pumps approach their normal operating temperature, and in extreme cases this drag torque, which may be a virtual lock-up of the pump, may entirely prevent the starting or operation of the associated equipment upon which the gear pump is used.

The applicants have discovered that this undesirable characteristic of conventional gear pumps is largely attributable to the conflicting requirements in the design of such a pump. On the one hand sufficiently close radial and axial clearances must be maintained within the pump so that leakage flows are kept to an acceptable minimum. On the other hand, acceptably large clearances must exist after a cold-soak so that the rotating and relatively sliding parts within the pump are not brought into forceful engagement with one another by the thermal contraction experienced during such cold soaking.

In view of the above it is apparent that a gear pump which is largely unaffected by cold soak as well as operation at high temperatures while still maintaining desirably close radial and axial clearances is highly desirable.

SUMMARY OF THE INVENTION

In view of the recognized deficiencies of conventional gear pumps which are set forth above, the present invention has as its object the provision of a gear pump particularly offering improved operation at low temperatures, and especially after an extended cold soak at such low temperatures as low as −65° F.

In order to accomplish the above, the present invention provides a gear pump wherein a pair of meshed pinions are received within a housing cavity. The meshed pinions are journaled within the housing by a pair of bearing members which are relatively moveable both in an axial and in a radial sense within the housing. One of the meshed gear members includes a shaft extending externally of the housing through a bore thereof to receive a driving torque input. During operation of the pump high pressure fluid originating with a trapped meshed volume between the pair of meshed gears is directed axially along the shaft portions which journal the gear members within the bushings and to a pair of pressure balance chambers at opposite ends of the pump. These pressure-balance chambers are communicated with the outlet port of the pump so that the aggregate of pressure forces acting on the bushings at these pressure-balance chambers exceeds slightly the pressure forces acting to separate the bushings at the gears. Consequently the pair of bushings are biased axially toward one another and capture the pair of meshed gears therebetween to control axial leakage clearances. In a similar way the pair of bushings as well as the pair of meshed pinion gears are relatively moveable within the cavity of the housing and are as a unit biased by pressure forces towards the inlet port of the pump. The pair of bushing members sealingly engage with the internal surfaces of the pump housing cavity in order to control leakage paths therearound. The pair of bushings are dimensioned to cooperatively control radial leakage paths between the outer gear tips of the gears and the housing itself. As a consequence of this advantageous construction, dimensions within the pump may be selected such that thermal contractions resulting from cold soak do not cause any of the relatively rotating and sliding components of the gear pump to seize against one another. Thus, the inventive pump avoids the undesirable characteristic of exceedingly high operating torques being generated when start up of the pump is desired after a cold-soak.

BRIEF DESCRIPTION OF THE DRAWING FIGURES

FIGS. 1A and 1B in combination depict an exploded perspective view of the present inventive pump and its component parts, with a portion of the housing being broken away to better illustrate internal features.

DETAILED DESCRIPTION OF A PREFERRED EMBODIMENT OF THE INVENTION

Figure 1A:
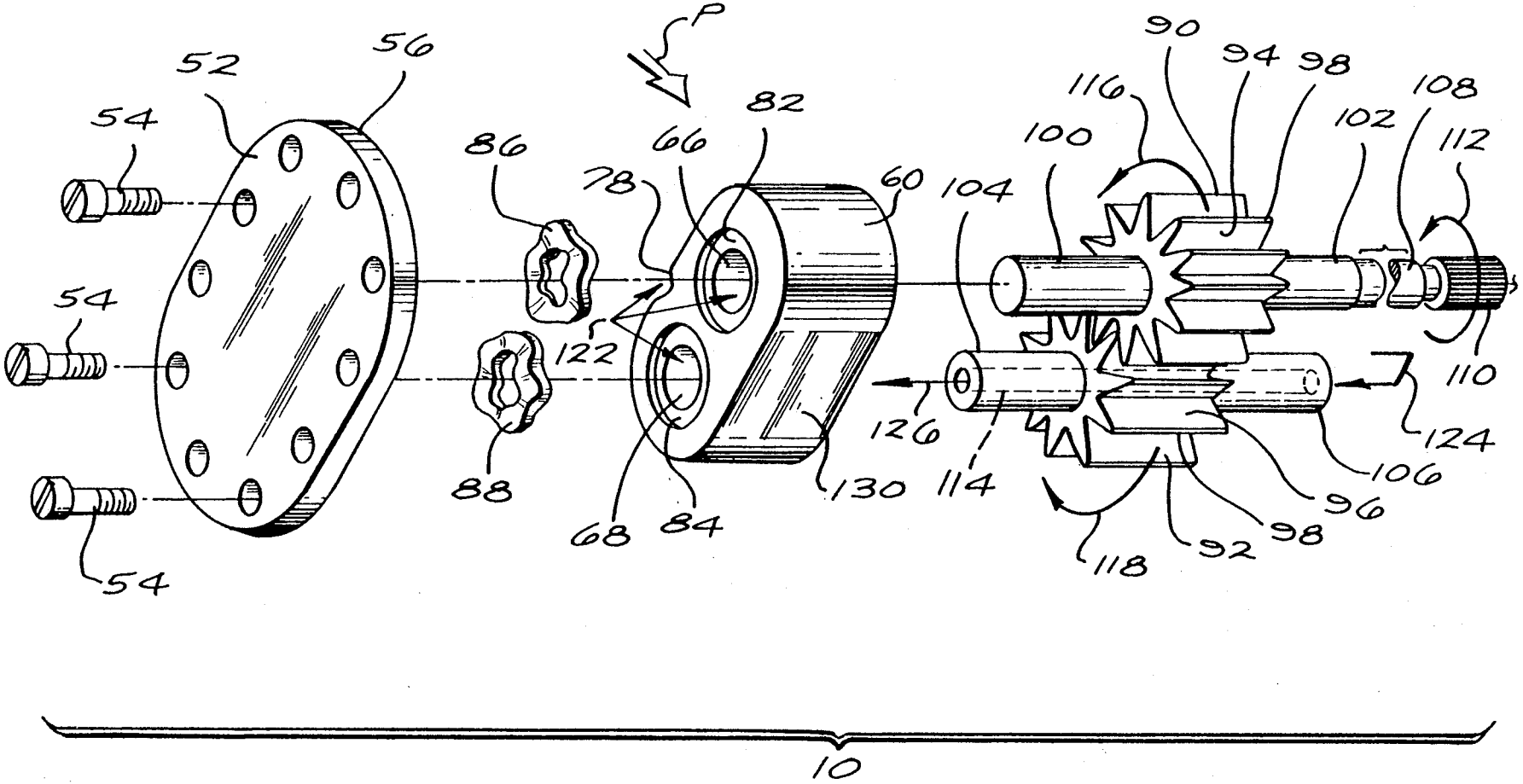
Figure 1B:
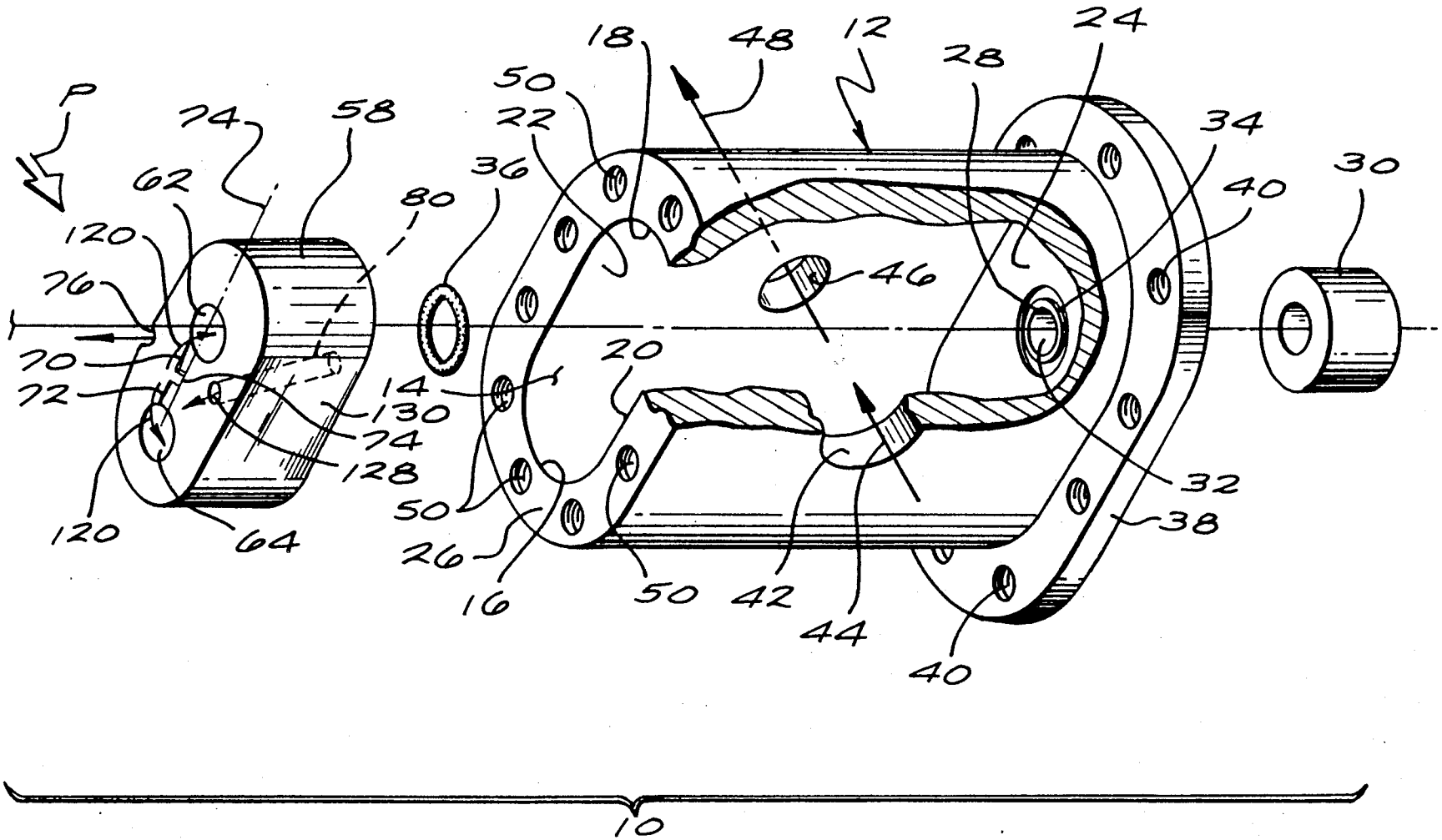

Viewing the drawing figure, a gear pump 10 includes a housing 12 defining a cylindrical recess 14 therein Geometrically the recess 14 is generally oval and includes a pair of spaced apart surface portions 16, 18 which are right circular semi-cylindrical. The surface portions 16, 18 are joined by side wall surface portions 20, 22 which are planar and tangent with the portions 16, 18. An end wall 24 closes one end of recess 14, while the recess opens on a surface 26 at its other end. The housing defines an axially extending stepped bore 28 on one of the cylindrical axes of the surfaces 16, 18, opening through the end wall 24 within a boss (not visible in the drawing Figure). A conventional shaft sealing member 30 is received in the boss in juxtaposition with a smaller diameter portion 32 of the bore 28, which latter bore portion opens to the recess 14. Spaced radially outwardly of the bore portion 32, the end wall 24 defines an annular groove 34 into which is received a resilient O-ring type sealing member 36.

The housing 12 includes a flange part 38 by which the pump 10 may be mounted to a driving device (not shown), for example, to a gear box, by a plurality of fasteners (also not shown) passing through bores 40 and engaging the gear box, or other drive device. An inlet port 42 is defined by the housing 12 and opens on the side wall surface portion 20 about midway between end wall 24 and the opening of recess 14 on surface 26. Via the inlet port 42, the pump 10 may receive an inlet flow of liquid, as is depicted by arrow 44. Similarly, the housing 12 defines an outlet port 46 opening from recess 14 on the surface 22, and from which the pump 10 may discharge an outlet flow of pressurized liquid, as depicted by arrow 48. At the surface 26, the housing 12 defines a plurality of threaded bores 50, by which a closure member 52 may be secured to the housing 12 by a plurality threaded fasteners 54. The closure member 52 defines a planar surface 56 sealingly engaging the surface 26 and spanning the recess 14 to close the latter at its opening on the housing 12.

Received into the recess 14 is a pair of bushing and sealing members 58, 60, which with the exception of two features which will be pointed out below, are substantially mirror image duplicates of one another. Geometrically, the bushing members 58, 60 are complements to the geometric shape of the recess 14, and are closely fitted therein with sufficient clearance space to always allow relative movement between each bushing and the housing 12. Importantly, the housing 12 may be made of metal, for example, an aluminum alloy. On the other hand, the bushings 58, 60 may be made of a metal, for example, of brass, or of carbon graphite. Regardless of the materials of construction from which the housing 12 and bushings 58, 60 are made, the clearance therebetween is chosen to be just sufficient to insure that the housing does not contract upon the bushings at very low temperatures, for example, temperatures as low as −65° F. Thus, the bushing 58, 60, are always movable axially and in a radial or lateral sense with respect to the cylindrical axes of the surfaces 16, 18 in recess 14.

Each of the bushing members 58, 60, defines a pair of axially extending through bores 62, 64, and 66, 68, respectively, which each are disposed at its centerline on the cylindrical axes of the surfaces 16, 18. Each bushing 58, 60 on its end face confronting the other bushing defines a pair of radially and circumferentially extending recesses 70, 72, only the recesses of bushing 58 being visible in the drawing Figure. The recesses 70, 72 extend radially from near respective ones of the bores 62–68 toward, but short of each other, and are disposed toward the outlet port 46 with respect to a diametrical line 74 between the center of bores 62–64, and 66–68. Each bushing 58, 60 also defines an axially extending groove 76, 78, respectively, extending axially from end to end thereof, and only the opening on the end surfaces thereof being visible in the drawing Figure.

Now with respect to the differences between the bushing members 58, 60, the former defines a passage 80 extending generally axially through the bushing member. The passage 80 opens on one axial face of the bushing 58 adjacent the bore 62 radially inwardly of the sealing cooperation of member 36 with the bushing. Passage 80 is angulated and opens on the opposite axial face of the bushing 58 generally centrally thereof and toward the inlet port 42 with respect to line 74. Similarly, the bushing 60, at its axial face disposed toward cover member 52 defines a pair of shallow counter bores 82, 84, surrounding the openings of the bores 66, 68 respectively. Received into each of the counterbores 82, 84, is a respective one of a pair of annular wave spring members 86, 88. The wave spring members 86, 88 engage the cover member 52 and bushing 60 to urge the latter and the entire contents of recess 14 toward end wall 24.

Also received into the recess 14 between the bushing members 58, 60, is a pair of meshed straight-cut spur gear members 90, 92. The spur gear members 90, 92 each include a plurality of gear teeth 94, defining intertooth spaces 96 therebetween. Geometrically, the outer diameter of the spur gear members 90, 92, as determined at addendum circle tip surfaces 98 of the teeth 94 is substantially the same as the cylindrical diameter of the surfaces 16, 18 of housing 12. Each of the gear members 90, 92, includes a pair of axially extending shaft portions, 100, 102, and 104, 106, respectively. The shaft portions 100–106 are rotatably journaled in the bores 62–68 so that the bushings 58, 60 alone journal the gears 90, 92.

Gear member 90 includes a drive shaft part 108 extending axially from and integral with the shaft portion 102. The drive shaft part 108 extends through bore 28 and sealing member 30 to project externally of the housing 12. Drive shaft part 108 includes a spline-defining termination section 110 whereat driving torque may be supplied to the pump 10, as depicted by arrow 112. Gear member 92, on the other hand, defines an axially extending central through bore 114 opening at opposite ends on the ends of the shaft portions 104, 106.

In use of the pump 10, the pair of bushings 58, 60 sandwich the pair of gear members 90, 92 therebetween and journal the shaft portions 100–106. The assembly of bushings 58, 60, and gear members 90, 92 is received into recess 14 with sealing member 36 in groove 34 sealingly engaging bushing 58. The wave spring members 86, 88 are received into counter bores 82, 84, and the closure member 52 closes the recess 14, and engages these wave spring members. Consequently, the bushing 60 is urged axially into sliding engagement with the axial faces of gear members 90, 94, and the latter are urged axially into sliding engagement at their axial faces with the bushing 60. Finally, bushing 60 is urged into engagement with end wall 24 and sealingly engages sealing member 36.

When the driving torque 112 causes rotation of the gear member 90, the gear member 92 is also rotated because of the mesh of these gears. Consequently, liquid 0 is inducted via port 42 (arrow 44) and is carried in the inter-tooth spaces 96 circumferentially around the gear members 90, 92 to outlet port 46 (arrow 48), as indicated by arrows (116, 118). Flow of liquid from the outlet port 46 toward inlet port 42 is substantially prevented by the intermeshing of the teeth 94, except that, as is well known in the art, an intermesh volume of liquid is trapped between the gear members 90, 92 as the teeth thereof approach full intermesh at the line 74. In order to relieve this trapped liquid volume, the recesses 70, 72 communicate the intermesh liquid volume radially inwardly toward the respective bore 62 and 64 and shaft portion 102, 106, as is indicated by arrows 120 in association with bushing member 58.

Consequently, a flow of lubricating and cooling liquid is forced axially along each bore 62–68 and shaft portion 100–106, recalling the arrows 120 at bushing 58, and as indicated by arrows 122 at bushing member 60. As indicated by the arrows 122, the liquid flow in bores 66, 68 is conveyed along the surface 56 of closure member 52 in the axial clearance space (not referenced) maintained by the springs 86, 88, to groove 78, and hence to outlet port 46. The liquid flow axially in bore 64 and along shaft portion 106 is conveyed about the end of this shaft portion, as indicated by arrow 124, and flows axially in the opposite direction through bore 114. This flow emerges from shaft portion 104 and bore 114, as indicated by arrow 126, into the same axial clearance space maintained by the springs 86, 88 and to the groove 78. Thus, this flow also is conveyed to outlet port 46.

In contrast to the above, the liquid flow axially in bore 62 and along shaft portion 102 exits into the angular space within sealing member 36. This liquid flows through passage 80 to communicate with the inlet port 42, as is indicated by arrow 128. Thus, about three-fourths of the intermesh trapped liquid volume is conveyed to the outlet port 46. Only about one-fourth of this intermesh trapped liquid volume is flowed back to the inlet port. The volumetric throughput of the present pump is thus improved over conventional designs, while the seal 30 is protected from exposure to outlet port fluid pressure.

During operation of the pump 10, the entire axial face of bushing 60 at the counter bores 82, 84 is exposed to fluid pressure at the outlet port 46. On the other hand the opposite axial face of bushing 58 is only partially exposed to outlet port fluid pressure because of the sealing member 36 and passage 80. Consequently, the contents of recess 14 are urged by fluid pressure toward end wall 24 so that the bushings 58, 60 sealingly engage the axial faces of the gear members 90, 92.

Also, the planar external surface of each bushing member as well as the semi-cylindrical surfaces (all confronting surfaces 16, 18, and 22 of housing 12) are exposed to fluid pressure at the outlet port 46. This external surface exposure of the bushing members 58, 60, in addition to the pressure differential effective across the pair of gear members 90, 92, urges the bushing members 58, 60 into sealing engagement with the planar surface 20 of the housing 12, depicted by arrows 'P', and as is indicated by shaded areas 130.

In view of the above, it can be appreciated that the assembly of bushings 58, 60 and gear members 90, 92 is floatingly received in the cavity 14, both with respect to axial relative movements to control leakage flows, and with respect to movements radially (or laterally) of the cylindrical axes of surfaces 16, 18 for the same purpose. The seal member 30 is selected to allow necessary axial and radial relative movement of shaft 108 while still preserving sealing relation therewith. When a newly assembled pump 10 is first operated for break in, manufacturing tolerances are taken up by relative movements of the gear members toward surface 20. Thus, the gear teeth tips 98 actually machine the interior of the housing 12 in the first few seconds of operation to provide a very close radial running clearance. This very close running clearance, with attendant very low internal fluid leakage rates, is thereafter preserved through a long service life for the pump 10.

Because of the floating pressure-balanced, self sealing interrelationship of the component parts of the pump 10, sufficient clearance between the bushings 58, 60 and housing 12 may be provided to prevent cold-soak binding of the pump. In contrast to conventional gear pump designs, some of which virtually lock up or become very difficult to rotate after a cold-soak at −65° F., the present inventive pump displays an almost negligible driving torque increase in this use. While conventional gear pumps appear to suffer from internal mechanical contacts and surface loadings resulting from required close running clearances and differential thermal contractions, the present pump allows use of sufficient large running clearances to avoid cold-soak increase of driving torque. The present inventive pump not only does not suffer any volume throughput penalty from use of the necessary running clearances outlined above, it enjoys a throughput advantage because about three-fourths of the intermesh trapped liquid volume flows to the outlet port.

What is claimed is:

1. A gear pump comprising:

a housing defining a cavity therewithin, an inlet port and an opposite outlet port both opening to said cavity;

a pair of bushing members movably received in said cavity and spaced axially apart on opposite sides of said ports to define a pumping chamber therebetween, each one of said pair parallel through bores, the bores in each of said pair of bushing members being axially aligned in pairs with the bores of the other of said pair of bushing members;

a pair of intermeshing gear members received in said pumping chamber, each one of said pair of gear members including a pair of oppositely axially extending shaft portions rotatably journaled in a respective axially aligned pair of said bores of said pair of busing members;

means for providing a driving torque input to one of said pair of gear members to rotate the gear members in opposite directions by virtue of the intermeshing thereof so as to ingest liquid at said inlet, deliver said liquid pressurized to said outlet port, and generate a pressurized, intermesh liquid trapped volume between said gear members; and flow path means for distributing said intermesh trapped liquid volume within said cavity so that said pair of bushing members are urged axially into sliding and sealing engagement with said pair of gear members, and simultaneously urged laterally into moveable sealing engagement with said housing adjacent said inlet port;

whereby said pair of bushing members journal said pair of gear members in said cavity while also sealingly cooperating therewith to inhibit liquid leakage therebetween, and also cooperating with said housing member to inhibit leakage between the latter and said pair of bushing members.

2. The invention of claim 1 wherein said cavity is axially elongate and of generally oval shape, said pair of bushing members each being complementary in shape with said cavity and slidably received therein, said inlet port and said outlet port opening to said cavity on opposite faces thereof which are generally parallel with the major axis of said oval shape.

3. The invention of claim 1 wherein said flow path means includes a respective pair of radially and circumferentially extending recesses disposed on an axial face of each one of said pair of bushing members confronting said pair of gear members, each one of said pair of recesses extending radially with respect to a respective one of said pair of through bores toward but short of the other of said pair of recesses and begin disposed circumferentially toward said outlet port with respect to a diametrical line connecting said pair of through bores, said recesses distributing intermesh of through bores of each of said pair of bushing members to additionally provide a lubricating and cooling liquid flow along said shaft portions.

4. The invention of claim 3 wherein said flow path means further includes a plurality of conduits distributing from said through bores all of said trapped intermesh liquid volume, save a remainder portion that flows along one of said shaft portions of said one gear member, to said outlet port, and an axially extending passageway disposed in one of said pair of bushing members for distributing said remainder portion of said trapped intermesh liquid volume to said inlet port.

5. The invention of claim 4 wherein said one shaft portion exposed to said remainder portion of said trapped intermesh liquid volume is integral with a drive shaft part extending axially therefrom and receiving said driving torque input, said housing defining a bore opening outwardly from said cavity and rotatably receiving said drive shaft part, and an annular sealing member spaced outwardly of and circumscribing said drive shaft part and sealingly cooperating both with the one of said pair of bushing members journaling said one shaft portion and with said housing.

6. A gear pump comprising:

a housing defining a cylindrical recess therein of generally oval shape having an end wall and opening outwardly upon said housing;

a pair of oval bushing members received movably in said recess in spaced apart relation at opposite ends of the latter, each of said pair of bushing members defining a pair of axially extending parallel through bores;

a pair of gear members intermeshing with one another received into said recess between said pair of bushing members, each one of said pair of gear members having a pair of opposite shaft portions extending axially therefrom and journaled in a respective through bore of said pair of bushing members, one of said shaft portions including a drive shaft part extending outwardly of said housing through an axially extending bore defining by the latter, said drive shaft part defining means for torque input externally of said gear pump, the other of said pair of gear members defining an axially extending central through bore opening at opposite ends on the ends of the respective pair of said shaft portions;

said housing defining an inlet port extending to said recess, and an outlet port opening from said recess, both ports opening on a respective opposite side wall of said recess in general alignment with said pair of gear members, at said end wall and spaced annularly around said axially extending bore and outwardly of said drive shaft part said housing sealingly cooperating with the adjacent one of said pair of bushing members, said one bushing member defining a passage extending from within said annular sealing cooperation of said housing therewith and communicating axially therethrough to said inlet port;

each of said pair of bushing members on a respective axially disposed face confronting said pair of gear members defining a pair of recesses extending radially and circumferentially toward but short of convergence and which are each disposed toward said outlet port with respect to a diametrical line between said shaft portions, said pair of recesses conveying an intermesh trapped liquid volume from said pair of gear members to said through bores and shaft portions journaled therein;

flow path means communicating with said outlet port the three of said through bores which area apart from said through bore journaling therein said shaft portion including said drive shaft part said flow path means further communicating said through bore apart from said three bores to said inlet port; and a closure member spanning and closing said cylindrical recess of said housing at the opening thereof.

7. The invention of claim 6 wherein said flow path means includes an axial clearance space defined between said closure member and the one of said pair of bushing members closest to said closure member, said axial clearance space communicating with said outlet port.

8. The invention of claim 7 wherein said flow path further includes said through bore of said other gear member, trapped liquid flowing along the respective shaft portion of said other gear member which extends toward said end wall subsequently flowing axially in the opposite direction in said through bore and to said axial clearance space.

9. The invention of claim 6 wherein each of said pair of bushing members sealingly cooperates with said housing at a lateral surface of said bushing members which is disposed toward said inlet port.

10. A method of operating a gear pump comprising the steps of:

associating in meshed relationship a pair of straight-cut spur gear members each including a pair of oppositely axially extending shaft portions;

journaling the pair of gear members in a pair of bushing members each defining a pair of spaced parallel through bores which align axially with one another in pairs and rotatably receive said shaft portions to journal the latter;

externally configuring said pair of bushing members to each include a spaced apart pair of right circular semi-cylindrical surface portions of diameter substantially the same as said gear members and a pair of lateral surface portions extending between said semi-cylindrical surface portions and tangent thereto;

enclosing said pair of gear members journaled by said pair of bushing member relatively movably within a housing cavity to which said pair of bushing members are complementary in shape, defining in said housing an inlet port opening to said cavity on one of the complementary lateral surfaces thereof, and defining in said housing an outlet port opening from said cavity from the other of the complementary lateral surfaces thereof;

rotating one of said pair of gear members to drive the other of said pair of gear members via the meshed relation thereof;

using rotation of said pair of gear members to induct liquid via said inlet port and deliver this liquid pressurized to said outlet port while generating a pressurized, intermesh liquid trapped volume between said gear members;

communicating a portion of said pressurized intermesh liquid to an axially disposed face of one of said pair of bushing members spaced from said pair of gear members;

utilizing said pressurized intermesh liquid acting upon said axially disposed face of said one bushing member to urge said pair of bushing members sealingly toward said pair of gear members;

communicating said portion of pressurized intermesh liquid at said axially disposed face to both of the lateral surfaces of said pair of bushing members which are disposed away from said inlet port;

communicating a remainder portion of said pressurized intermesh liquid to both of the lateral surfaces of said pair of bushing member adjacent said inlet port, said remainder portion being less than said portion; and utilizing said portion of pressurized intermesh liquid acting upon said lateral surfaces of said pair of bushing members to urge the latter at the opposite lateral surfaces thereof into sealing relation with said housing.

* * * * *

UNITED STATES PATENT AND TRADEMARK OFFICE

CERTIFICATE OF CORRECTION

PATENT NO. : 5,076,770

DATED : December 31, 1991

INVENTOR(S) : Dabling et al

It is certified that error appears in the above-identified patent and that said Letters Patent is hereby corrected as shown below:

Column 7, line 7, between "pair and "parallel", insert "of bushing members defining a pair of axially extending spaced".

Column 7, line 54, between "intermesh" and "of", insert "trapped liquid volume from said pair of gear members to said pair".

Column 8, line 57, replace "area" with "are".

Signed and Sealed this

Thirteenth Day of April, 1993

*Attest:*

STEPHEN G. KUNIN

*Attesting Officer*

*Acting Commissioner of Patents and Trademarks*